US007261281B2

(12) United States Patent
Raffenberg

(10) Patent No.: US 7,261,281 B2
(45) Date of Patent: Aug. 28, 2007

(54) CARBURETOR

(75) Inventor: Michael Raffenberg, Fellbach (DE)

(73) Assignee: Andreas Stihl AG & Co. KG (DE)

( * ) Notice: Subject to any disclaimer, the term of this patent is extended or adjusted under 35 U.S.C. 154(b) by 66 days.

(21) Appl. No.: 11/303,057

(22) Filed: Dec. 14, 2005

(65) Prior Publication Data

US 2006/0131763 A1 Jun. 22, 2006

(30) Foreign Application Priority Data

Dec. 21, 2004 (DE) ..... 10 2004 061 397

(51) Int. Cl.
*F02M 23/03* (2006.01)

(52) U.S. Cl. ..... 261/44.8; 123/73 PP; 261/46; 261/48; 261/62; 261/63; 261/DIG. 1

(58) Field of Classification Search ..... 261/23.3, 261/44.6, 44.8, 46–48, 55, 62, 63, DIG. 1; 123/73 PP See application file for complete search history.

(56) References Cited

U.S. PATENT DOCUMENTS 3,205,879 A * 9/1965 von Seggem et al. ..... 123/581
4,294,205 A * 10/1981 Iiyama et al. ..... 123/274
6,101,991 A * 8/2000 Glover ..... 123/73 PP
6,328,288 B1 * 12/2001 Gerhardy ..... 261/35
6,418,891 B2 * 7/2002 Kobayashi ..... 123/73 PP
6,662,767 B1 * 12/2003 Nonaka ..... 123/73 A
6,708,958 B1 * 3/2004 Warfel et al. ..... 261/45
7,011,298 B2 * 3/2006 Gerhardy et al. ..... 261/46
7,090,204 B2 * 8/2006 Zwimpfer et al. ..... 261/46
7,093,570 B2 * 8/2006 Mavinahally et al. ..... 123/73 D
2001/0020454 A1 * 9/2001 Kobayashi ..... 123/73 A
2003/0106508 A1 * 6/2003 Rosskamp ..... 123/73 PP
2003/0106509 A1 * 6/2003 Uenoyama et al. ..... 123/73 PP
2003/0192492 A1 * 10/2003 Yuasa et al. ..... 123/73 PP
2004/0051186 A1 * 3/2004 Gerhardy et al. ..... 261/43
2004/0251564 A1 * 12/2004 Mavinahally ..... 261/23.3
2005/0073062 A1 * 4/2005 Zwimpfer et al. ..... 261/65

FOREIGN PATENT DOCUMENTS

EP 1 098 084 5/2001
JP 57-13257 A * 1/1982 ..... 261/23.3

* cited by examiner

*Primary Examiner*—Richard L. Chiesa
(74) *Attorney, Agent, or Firm*—Robert W. Becker & Associates; Robert W. Becker

(57) ABSTRACT

A carburetor including a mixture channel and an air channel that are separated from one another, wherein a fuel opening opens into the mixture channel. A throttle element is rotatable about an axis of rotation that extends transverse of the direction of flow in the mixture channel and in the air channel and extends through both channels. As a function of its position, the throttle element throttles a flow cross-section of the mixture channel and the air channel. The flow cross-section of a portion of the mixture channel and/or of the air channel has a non-circular shape in the vicinity of the throttle element.

17 Claims, 4 Drawing Sheets

CARBURETOR

The instant application should be granted the priority date of Dec. 21, 2004, the filing date of the corresponding German patent application 10 2004 063 397.4.

BACKGROUND OF THE INVENTION

The present invention relates to a carburetor, especially for a two-stroke engine in a manually-guided or portable implement such as a power saw, a brush cutter, a cut-off machine, or the like.

A cylinder-type carburetor is known from EP 1 098 084 A1, according to which a portion of the mixture channel is formed in a cylinder, which acts as a throttle element. It is also known to embody such cylinder-type carburetors in such a way that the cylinder extends through not only the mixture channel but also the air channel of a scavenging two-stroke engine and controls both channels. The drawback of the known carburetors is that they have a large overall size.

It is an object of the present application to provide a carburetor of the aforementioned general type that has a small overall size.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
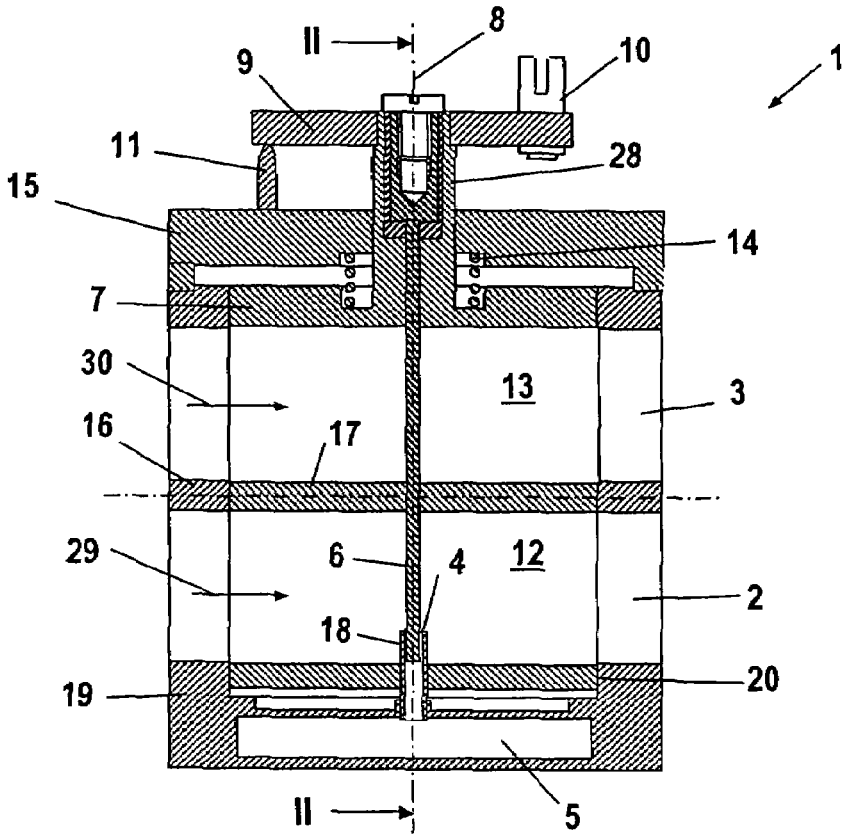
FIG. 1 is a cross-sectional view through one exemplary embodiment of an inventive carburetor.

The carburetor of the present application comprises a mixture channel and an air channel that are separated from one another, wherein a fuel opening opens into the mixture channel, wherein a throttle element is provided that is rotatable about an axis of rotation that extends transverse to the direction of flow in the mixture channel and in the air channel and extends through both of them, wherein the throttle element, as a function of its position, throttles the flow cross-section of the mixture channel and the air channel, and wherein the flow cross-section of a portion of the mixture channel and/or of the air channel has a non-circular shape in the vicinity of the throttle element.

Due to the special configuration of the portion of the mixture channel and/or of the air channel that is disposed in the vicinity of the throttle element, it is possible to make better use of the installation space that is available. As a result, the overall size of the carburetor can be reduced.

Advantageously, the height, as measured in the direction of the axis of rotation, of the channel portion having the non-circular flow cross-section is smaller than the width, as measured perpendicular to the axis of rotation. As a result, the overall size of the carburetor in the direction of the axis of rotation can be reduced. A good utilization of the installation space can be achieved as a result of the mixture channel and the air channel in the carburetor being separated from one another by a partition. This partition is in particular fixed in position on the carburetor. A straightforward configuration can be achieved if a partition section is fixed in position on the throttle element. The partition section can, in particular, be monolithically formed with the throttle element, and during manufacture of the throttle element, for example in an injection molding process, can be produced in a single operation with the throttle element. As a result, the expense for manufacturing and assembly can be reduced.

A channel portion can have an elliptical flow cross-section. However, it can also be advantageous for a channel portion to be delimited by a planar wall section. In this connection, the planar wall section is, in particular, formed by a partition section. As a result, the two channel portions can be disposed immediately adjacent to one another, thus enabling large flow cross-sections accompanied by a small overall size of the carburetor. The channel portion in particular has a semicircular flow cross-section. The mixture channel portion and the air channel portion in the vicinity of the throttle element have non-circular cross-sections. In particular with semicircular cross-sections, the channels can be easily manufactured by providing a bore and dividing the bore into the two channels by a partition.

The air channel portion and the mixture channel portion advantageously have different flow cross-sections in the vicinity of the throttle element. The throttle element is, in particular, a cylinder in which a portion of the mixture channel and a portion of the air channel are formed. The cylinder is advantageously mounted in the housing of the carburetor so as to be movable in the direction of the axis of rotation. A needle is expediently fixed in position on the cylinder, and extends into the fuel opening. In this connection, the needle controls the quantity of fuel supplied to the mixture channel as a function of the position of the cylinder. The position of the cylinder in the direction of the axis of rotation is advantageously coupled to the rotational position of the cylinder, so that when the channels are completely opened, a large quantity of fuel is supplied, and with the channels partially or nearly entirely closed, only a small quantity of fuel can pass into the mixture channel.

To achieve different opening characteristics for the air channel and the mixture channel, the longitudinal central axis of the mixture channel portion formed in the cylinder has an offset, in a direction perpendicular to the axis of rotation, relative to the longitudinal central axis of the air channel portion formed in the cylinder. As a result, a delayed opening of one of the channels can be achieved. Depending upon the desired opening characteristic, either the mixture channel or the air channel is offset relative to the axis of rotation. Thus, by selecting a suitable shape of the channel cross-section and a suitable offset, the throttling characteristic of the carburetor can be easily influenced. A straightforward construction of the carburetor can be achieved if the throttle element is embodied as a butterfly valve.

Further specific features of the present application will be described in detail subsequently.

DESCRIPTION OF SPECIFIC EMBODIMENTS

Referring now to the drawings in detail, the carburetor 1 shown in FIG. 1 has a housing 19 in which are formed a mixture channel 2 and an air channel 3. The housing 19 is closed off by a cover 15. Formed in the housing 19 is a receiving means 20 in which the cylinder 7 is mounted so as to be rotatable about an axis of rotation 8 and so as to be displaceable in the direction of the axis of rotation 8. The cylinder 7 is yieldingly mounted relative to the cover 15 by a spring 14. Formed in the cylinder 7 are a mixture channel portion 12 and an air channel portion 13. The axis of rotation 8 extends through both of the channels 2, 3 perpendicular to the direction of flow 29, 30 in the channels. In this connection, the axis of rotation 8 extends perpendicular to a partition 16 that separates the two channels 2, 3 from one another. However, the axis of rotation 8 can also extend at an angle of less than 90° relative to the partition 16. Disposed in the housing 19 is a fuel reservoir 5 that opens into the mixture channel 2 by means of a fuel connector 18. Fixed in position in the cylinder 7 is a needle 6 that extends into the fuel connector 18. The needle 6 closes off the fuel connector 18 only partially, so that a fuel opening 4 is formed between the fuel connector 18 and the needle 6. The fuel passes into the mixture channel 2 through the fuel opening 4.

During operation, combustion air flows through the mixture channel 2 in the direction of flow 29. Fuel is supplied to the combustion air via the fuel opening 4, thus forming a fuel/air mixture that can be conveyed to an internal combustion engine, especially to the two-stroke engine of a manually-guided implement such as a power saw, a cut-off machine, or the like. Combustion air also flows through the air channel 3 in the direction of flow 30. The mixture channel 2 and the air channel 3 are separated from one another by a partition 16. The partition 16 extends to the cylinder 7. Formed in the cylinder 7 is a partition section 17 that is in particular monolithically formed with the cylinder 7. The partition section 17 adjoins the partition 16, thereby forming a continuous separation of the channels. By means of a connector 28, the cylinder 7 extends to the outside of the housing 19. Fixed in position on the connector 28 is a lever 9 that rests upon a ramp 11 on the housing 19. As a consequence of the spring 14 the lever 9 is pressed against the ramp 11. On that side of the lever 9 opposite the ramp 11, there is disposed a fixing means 10 which is engaged by an actuating element for the cylinder 7, such as the gas cable. The ramp 11 is embodied in such a way that the spacing of the lever 9 from the cover 15 is the greatest in the completely opened position of the cylinder 7, and decreases as the channels increasingly close. As a result, during closing of the cylinder 7, the needle 6 is pressed further into the fuel connector 18, thus reducing the amount of fuel that is supplied to the mixture channel 2.

Figure 2:
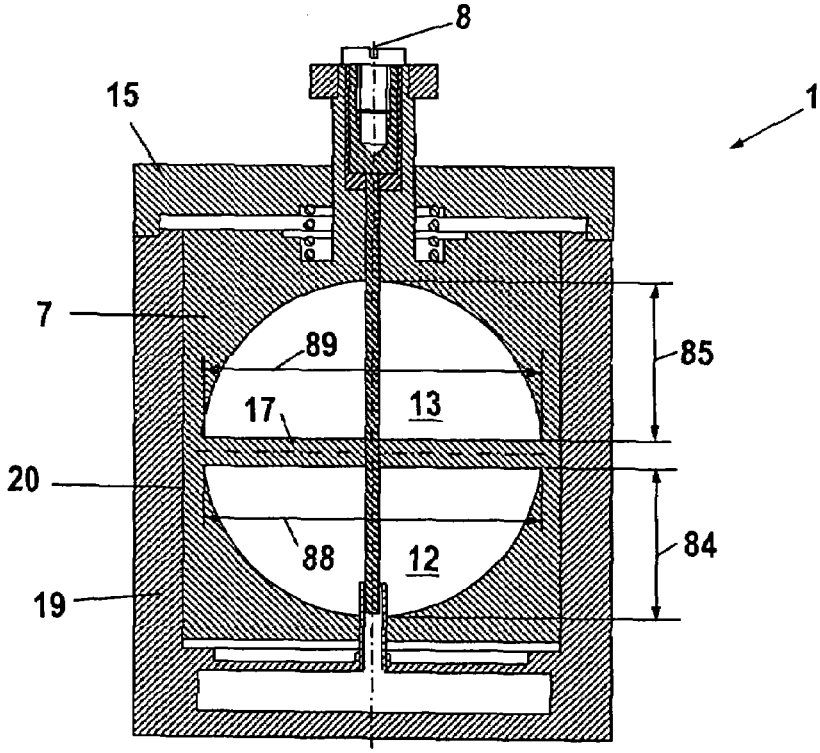
FIG. 2 is a cross-sectional view taken along the line II-II in FIG. 1.

As shown in the cross-sectional view of FIG. 2, the portions 12 and 13 of the mixture channel 2 and the air channel 3 formed in the cylinder 7 have a semicircular configuration. In this connection, the semicircular flow-cross sections are respectively delimited by the partition section 17. Thus, in the carburetor 1, and in particular in the cylinder 7, a channel having a circular cross-section is formed that is divided by the partition 16 and the partition section 17 into the mixture channel 2 and the air channel 3. The height 84 of the mixture channel portion 12, as measured parallel to the axis of rotation 8 and perpendicular to the partition 16, corresponds to the height 85 of the air channel portion 13, which is measured in the same direction. The width 88 of the mixture channel portion 12 which is measured perpendicular to the axis of rotation 8 and to the direction of flow 29, corresponds to the width 89 of the air channel portion 13. In the embodiment of FIGS. 1 and 2, the width 88, 89 of the mixture channel portion 12 and of the air channel portion 13 is more than twice as great as the height 84, 85 of the two channel portions. As a result, the carburetor 1 has a compact construction.

Figure 3:
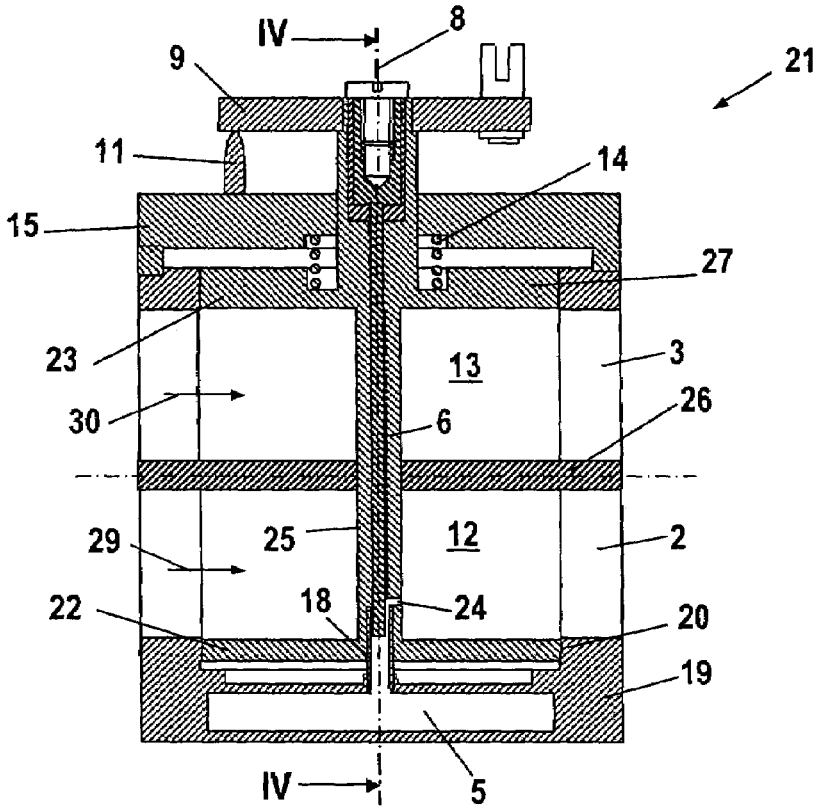
FIG. 3 is a cross-sectional view through another exemplary embodiment of a carburetor.
Figure 4:
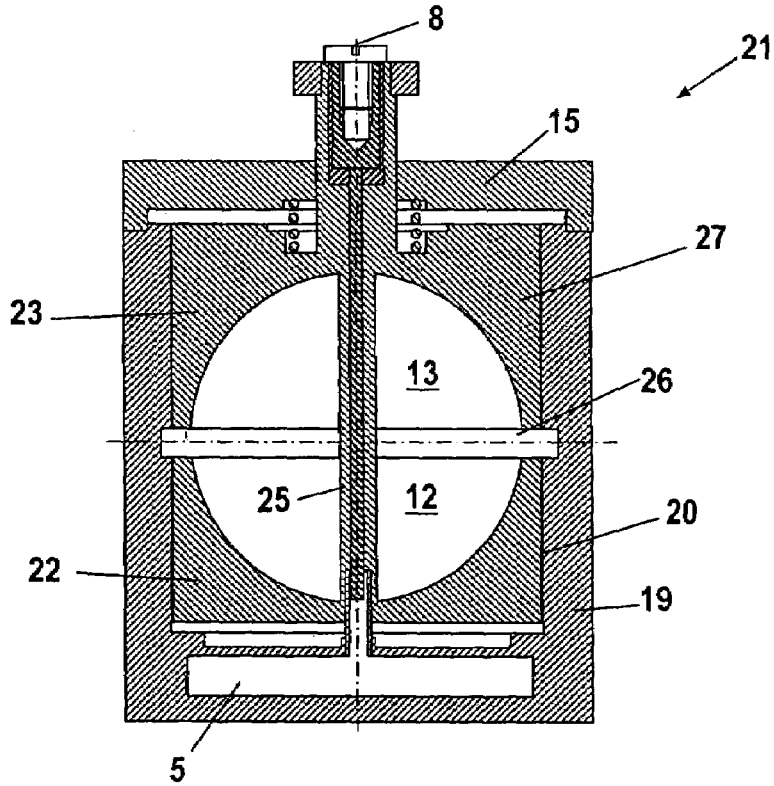
FIG. 4 is a cross-sectional view taken along the line IV-IV in FIG. 3.

FIGS. 3 and 4 illustrate a carburetor 21 having a construction that corresponds essentially to that of the carburetor 1 shown in FIGS. 1 and 2. The same reference numerals designate the same components of the two carburetors. Mounted in the housing 19 of the carburetor 21 is a cylinder 27 in the receiving means 20. The cylinder 27 is mounted so as to be movable in the direction of the axis of rotation 8 and so as to be rotatable about the axis of rotation 8. The cylinder 27 has two portions 22 and 23, which are fixedly interconnected by a sleeve 25. The sleeve 25 can be monolithically formed with the two portions 22 and 23 of the cylinder 27. However, the sleeve 25 can also be fixed in position on the two portions 22, 23. The portion 22 delimits a mixture channel portion 12, and the portion 23 of the cylinder 27 delimits an air channel portion 13. The air channel portion 13 is separated from the mixture channel portion 12 by a partition 26. The partition 26 is held in the housing 19 of the carburetor 21, with the needle 6, and the sleeve 25 that surrounds the needle 6, passing centrally through the partition 26. To enable a simple manufacture, the partition 26 is constructed in two parts. In this connection, one part of the partition 26 is disposed upstream of the axis of rotation 8, and the second part of the partition 26 is disposed downstream of the partition 8, as viewed in the direction of flow 29, 30. The two sections of the partition 26 abut one another in the sectional plane illustrated in FIG. 4. The sleeve 25 has a fuel opening 24, which connects the gap between the needle 6 and the fuel connector 18 with the mixture channel portion 12. The portions 12, 13 of the mixture channel 2 and the air channel 3 formed in the cylinder 27 have a semicircular cross-section that is delimited on one side by the planar partition 26.

Figure 5:
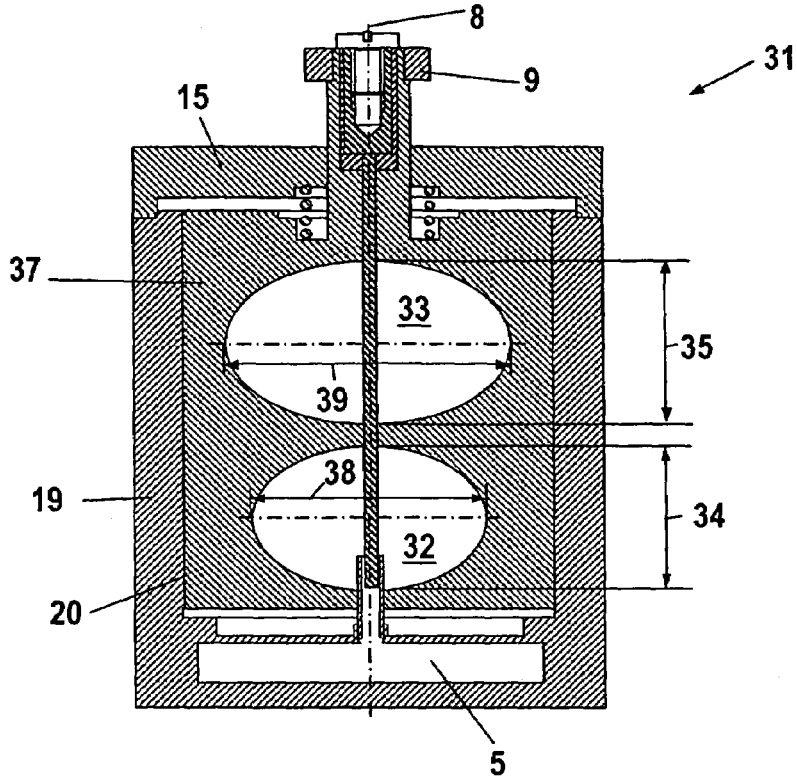
FIGS. 5-8 are cross-sectional views through further carburetors.

FIG. 5 is a cross-sectional illustration of a carburetor 31. In the housing 19 of the carburetor 31, a cylinder 37 is mounted in the receiving means 20 so as to be rotatable about the axis of rotation 8. The cylinder 27 has two openings, which extend perpendicular to the axis of rotation 8. Both openings have an elliptical cross-section. The opening facing the fuel reservoir 5 delimits a mixture channel portion 32. The height 34 in the mixture channel portion 32, measured in the direction of the axis of rotation 8, is less than the width 38, measured perpendicular to the axis of rotation. The flow cross-section in an air channel portion 33, which is formed in the cylinder 37 on the side facing the lever 9, has a greater flow cross-section than does the mixture channel portion 32. The height 35, which is measured parallel to the axis of rotation 8, is less than the width 39 of the air channel portion 33, measured perpendicular to the axis of rotation. However, the height 35 of the air channel portion 33 is greater than the height 34 of the mixture channel portion 32, and the width 39 of the air channel portion 33 is greater than the width of the mixture channel portion 32. The cylinder 37 can, for example, be made of polymeric material and can be produced in a single operation in an injection molding process with the openings that delimit the channel portions.

Figure 6:
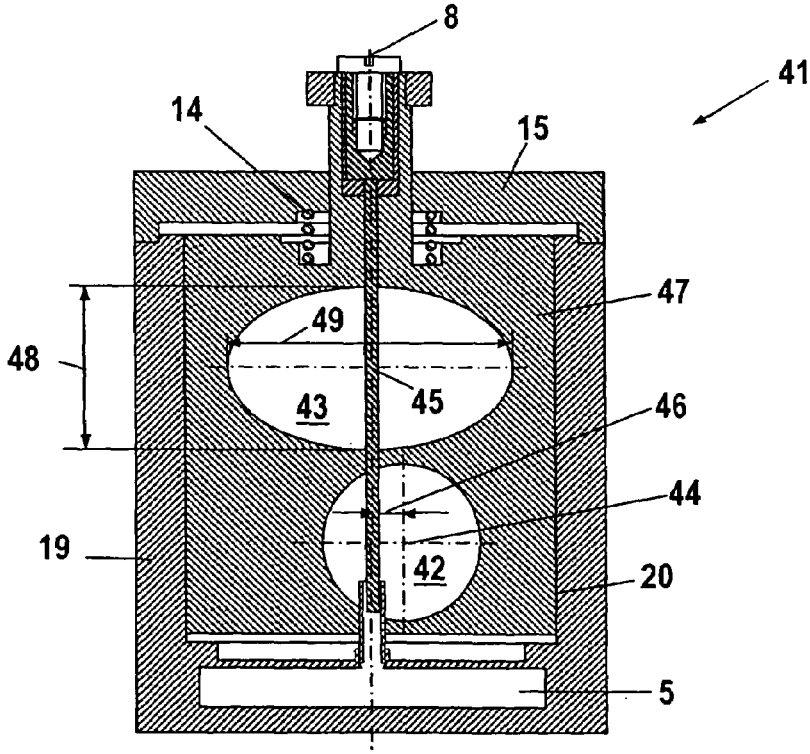

The carburetor 41 shown in FIG. 6 has a cylinder 47 mounted in the receiving means 20 in the housing 19. Disposed in the cylinder 47 is an air channel portion 43, which has an elliptical flow cross-section. The width 49 of the air channel portion 43 is greater than the height 48 of the air channel portion 43. The longitudinal central axis 45 of the air channel portion 43, which interconnects the geometrical center points of all of the flow cross-sections, intersects the axis of rotation 8. Formed in the cylinder 47 is a mixture channel portion 42, which has a circular flow-cross section. The longitudinal central axis 44 of the mixture channel portion 42 has an offset 46 relative to the longitudinal central axis 45 of the air channel portion 43 as viewed in the direction of the axis of rotation 8. The longitudinal central axis 44 is spaced from the axis of rotation 8. As a result, the mixture channel portion 42 opens after the air channel portion 43. The opening characteristic can be influenced by the selection of the position of the longitudinal central axes 44, 45 of the channels. It can be advantageous for the air channel portion 43 to be spaced from the axis of rotation 8 such that the air channel portion 43 opens after the mixture channel portion 42.

Figure 7:
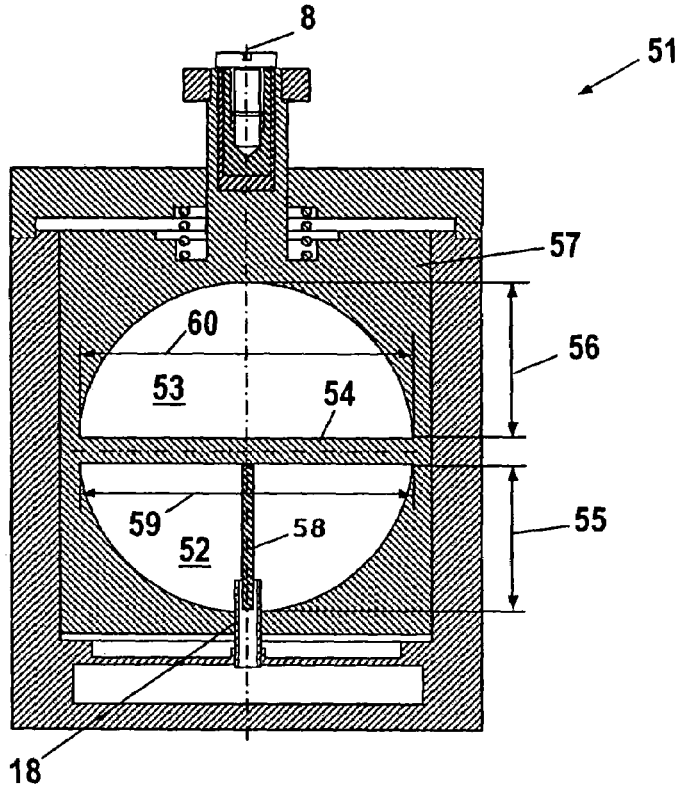

The carburetor 51 shown in FIG. 7 corresponds essentially to the carburetor 1 shown in FIGS. 1 and 2. The carburetor 51 has a cylinder 57 in which are disposed a mixture channel portion 52 and an air channel portion 53. The two portions are separated from one another by a partition section 54 that is monolithically formed with the cylinder 57. Both channel portions 52, 53 have a semicircular cross-section. With the carburetor 51, the needle 58, which extends into the fuel connector 18, is fixed in position on the partition section 54. The needle 58 does not extend through the air channel portion 53, so that the needle 58 does not influence the flow cross-section in the air channel portion 53. The width 59, 60 of the mixture channel portion 52 and of the air channel portion 53 is more than twice as great as the height 55, 56 of the two channels measured perpendicular to the width 59, 60.

Figure 8:
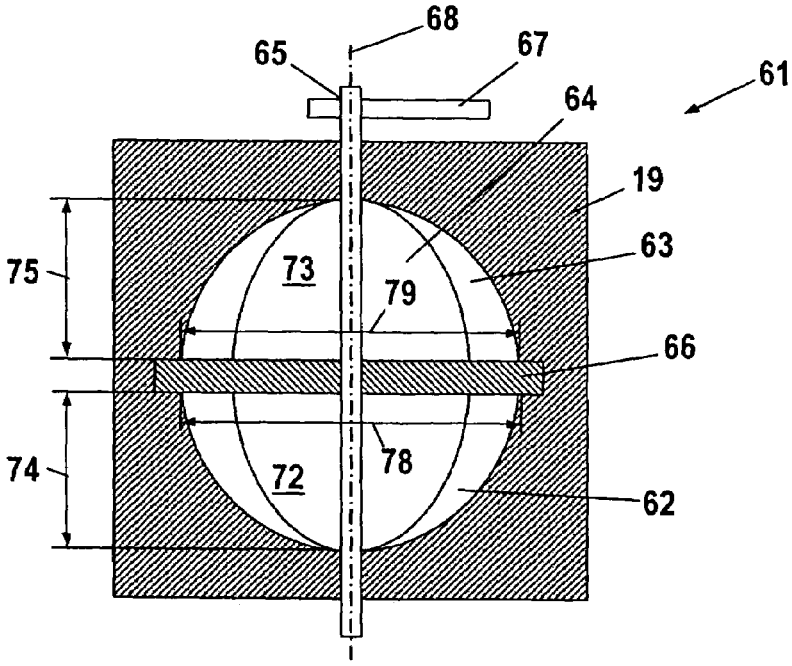

With the carburetor 61 shown in FIG. 8, fixed in position in the carburetor housing 19 is a partition 66, which separates a mixture channel 62 from an air channel 63. The two channels 62, 63 are formed by a continuous channel that has a circular cross-section and that is divided by the partition 66 into two equally sized channels having a semicircular cross-section. In the carburetor 61, a throttle or butterfly valve 64 is fixed in position on throttle shaft 65. The butterfly valve 64 is mounted so as to be pivotable about an axis of rotation 68. A lever 67 for actuating the butterfly valve 64 is disposed on an end of the throttle shaft 65 that projects outside the housing 19. The butterfly valve 64 has the two sections 72 and 73, whereby the section 72 is disposed in the mixture channel 62, and the section 73 is disposed in the air channel 63. The two sections 72, 73 rest against the partition 66, or are slightly spaced therefrom. The axis of rotation 68 is perpendicular to the partition 66 and intersects the air channel 63 and the mixture channel 62. The two sections 72, 73 of the butterfly valve 64 are fixedly interconnected. However, a different type of connection of the two sections 72, 73 of the butterfly valve 64 can also be provided. As a result, upon actuation of the lever 67, a control of the two channels 62, 63 can be achieved. The mixture channel 62 and the air channel 63 have a respective height 74, 75 in the direction of the axis of rotation 68 that is less than half of the width 78, 79 measured perpendicular to the axis of rotation 68. A fuel opening, which is not shown in FIG. 8, opens into the mixture channel 62.

Other cross-sectional shapes for the air channel and mixture channel formed in the carburetor can also be advantageous. For example, in order to be able to realize a narrow, elongated structural shape of the carburetor, it can be expedient for the height of the channels to be greater than their width measured perpendicular to their axis of rotation of the throttle element. Instead of a cylinder or a butterfly valve, other throttle elements can also be advantageous.

A carburetor pursuant to the present application can be utilized for a scavenging two-stroke engine. Extensively fuel-free air in the air channel is supplied to the scavenging two-stroke engine, with such air having been previously collected in the transfer channels of the engine. The mixture channel opens in particular into the crankcase. The air collected in the transfer channels separates the exhaust gases in the combustion chamber from the fresh mixture that flows in subsequently from the crankcase, resulting in low exhaust gas values of the two-stroke engine. The two-stroke engine is preferably used in a manually-guided implement such as a brush cutter, a power saw, a cut-off machine, or the like. Particularly advantageous is the use of the inventive carburetor with a two-stroke engine having a small piston displacement, preferably a piston displacement of less than 50 $cm^3$.

The specification incorporates by reference the disclosure of German priority document 10 2004 061 397.4 filed Dec. 21, 2004.

The present invention is, of course, in no way restricted to the specific disclosure of the specification and drawings, but also encompasses any modifications within the scope of the appended claims.

The invention claimed is:

1. A carburetor comprising a mixture channel and an air channel that are separated from one another, wherein a fuel opening opens into the mixture channel, wherein said carburetor is provided with a throttle element that is rotatable about an axis of rotation that extends transverse to a direction of flow in said mixture channel and in said air channel and extends through said mixture channel and said air channel, wherein said throttle element, as a function of its position, throttles a flow cross-section of said mixture channel and said air channel, and wherein said flow cross-section of a portion of at least one of said mixture channel and said air channel has a non-circular shape in the vicinity of said throttle element.

2. A carburetor according to claim 1, wherein a height as measured in the direction of said axis of rotation of said channel portion having said non-circular shape is smaller than a width thereof measured perpendicular to said axis of rotation.

3. A carburetor according to claim 1, wherein said mixture channel and said air channel are separated from one another by a partition.

4. A carburetor according to claim 3, wherein said partition (16, 26, 66) is fixed in position on said carburetor.

5. A carburetor according to claim 3, wherein a partition section is fixed in position on said throttle element.

6. A carburetor according to claim 5, wherein said throttle element is monolithically formed with said partition section.

7. A carburetor according to claim 1, wherein said channel portion has an elliptical flow cross-section.

8. A carburetor according to claim 1, wherein said channel portion is delimited by a planar wall section.

9. A carburetor according to claim 8, wherein said planar wall section is formed by a partition section.

10. A carburetor according to claim 8, wherein said channel portion has a semicircular flow cross-section.

11. A carburetor according to claim 1, wherein said channel portion is a mixture channel portion and an air channel portion having non-circular flow cross-sections in a vicinity of said throttle element.

12. A carburetor according to claim 1, wherein said channel portion is a mixture channel portion and an air channel portion having different flow cross-sections in the vicinity of said throttle element.

13. A carburetor according to claim 1, wherein said throttle element is a cylinder in which are formed a portion of said mixture channel and a portion of said air channel.

14. A carburetor according to claim 13, wherein said cylinder is mounted in a housing of said carburetor so as to be movable in a direction of said axis of rotation.

15. A carburetor according to claim 13, wherein a needle is fixed in position on said cylinder, and wherein said needle extends into said fuel opening.

16. A carburetor according to claim 13, wherein a longitudinal central axis of said mixture channel portion formed in said cylinder has an offset, in a direction perpendicular to said axis of rotation, relative to a longitudinal central axis of said air channel portion formed in said cylinder.

17. A carburetor according to claim 1, wherein said throttle element is a butterfly valve.

* * * * *